US007062193B2

(12) United States Patent
Kinouchi et al.

(10) Patent No.: US 7,062,193 B2
(45) Date of Patent: Jun. 13, 2006

(54) FIXING DEVICE THAT IS DETACHABLE FROM AN IMAGE FORMING APPARATUS

(75) Inventors: Satoshi Kinouchi, Tokyo (JP); Osamu Takagi, Tokyo (JP); Kazuhiko Kikuchi, Yokohama (JP); Hisaaki Kawano, Chigasaki (JP); Hiroshi Nakayama, Kawasaki (JP); Kenji Takano, Tokyo (JP); Taizo Kimoto, Tokyo (JP); Noriyuki Umezawa, Yokohama (JP); Masahiko Ogura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/927,129

(22) Filed: Aug. 27, 2004

(65) Prior Publication Data

US 2005/0025516 A1 Feb. 3, 2005

Related U.S. Application Data

(63) Continuation of application No. 10/290,296, filed on Nov. 8, 2002, now Pat. No. 6,813,456, which is a continuation of application No. 09/939,572, filed on Aug. 28, 2001, now Pat. No. 6,522,846, which is a continuation of application No. PCT/JP99/07411, filed on Dec. 28, 1999.

(51) Int. Cl.

| | |
|---|---|
| ***G03G 15/00*** | (2006.01) |
| ***G03G 15/16*** | (2006.01) |
| ***G03G 15/20*** | (2006.01) |

(52) U.S. Cl. ..... 399/90; 399/122; 399/330; 219/216; 219/660

(58) Field of Classification Search ..... 399/90, 399/122, 328, 330; 219/216, 469, 470, 471, 219/541, 619, 643, 644, 660; 439/928, 928.1
See application file for complete search history.

(56) References Cited

U.S. PATENT DOCUMENTS

| | | | |
|---|---|---|---|
| 3,287,542 | A | 11/1966 | Weitzner |
| 3,403,240 | A | 9/1968 | Henderson et al. |
| 4,571,488 | A | 2/1986 | Reeves |
| 5,032,703 | A | 7/1991 | Henschen et al. |
| 5,064,978 | A | 11/1991 | Scholz |
| 5,130,751 | A | 7/1992 | Sato et al. |
| 5,177,529 | A | 1/1993 | Schroll et al. |
| 5,461,215 | A | 10/1995 | Halderman |

(Continued)

FOREIGN PATENT DOCUMENTS

| | | |
|---|---|---|
| JP | 57-001482 | 1/1982 |

(Continued)

*Primary Examiner*—Robert Beatty
(74) *Attorney, Agent, or Firm*—Foley & Lardner LLP

(57) ABSTRACT

An electrophotographic fixing device allowing a flow of an AC current through an electromagnetic induction coil arranged close to a heating roller having a metal layer formed of a conductor and allowing the heat generation of the heating roller to heat a to-be-fixed member, in which the fixing device comprises a circuit board for outputting the AC current from an output terminal and passing the current through the electromagnetic induction coil, a conductive plate metal having one end side fixed by a fastening screw to the output terminal of the circuit board, a male-side connection terminal provided on the other end of the plate metal, and a female-side connection terminal provided at an end of a leader line of the electromagnetic induction coil and detachably connected to a male-side connection terminal.

30 Claims, 4 Drawing Sheets

U.S. PATENT DOCUMENTS

| | | | | |
|---|---|---|---|---|
| 5,815,771 | A | 9/1998 | Dhande et al. | |
| 5,994,682 | A | 11/1999 | Kelley et al. | |
| 6,059,611 | A | 5/2000 | Davis et al. | |
| 6,210,208 | B1 | 4/2001 | Barnes et al. | |
| 6,252,212 | B1 | 6/2001 | Takagi et al. | |
| 6,255,633 | B1 | 7/2001 | Takagi et al. | |
| 6,262,404 | B1 | 7/2001 | Higaya et al. | |
| 6,337,969 | B1 | 1/2002 | Takagi et al. | |
| 6,373,035 | B1 | 4/2002 | Okamoto et al. | |
| 6,498,906 | B1 | 12/2002 | Kimoto et al. | |
| 6,522,846 | B1 | 2/2003 | Kinouchi et al. | |
| 6,813,456 | B1 * | 11/2004 | Kinouchi et al. | 399/90 |

FOREIGN PATENT DOCUMENTS

| | | | |
|---|---|---|---|
| JP | 59-033476 | | 2/1984 |
| JP | 61-78012 | | 4/1986 |
| JP | 5-15218 | | 2/1993 |
| JP | 6-258971 | A | 9/1994 |
| JP | 7-219373 | A | 8/1995 |
| JP | 7-269774 | | 10/1995 |
| JP | 8-044233 | A | 2/1996 |
| JP | 9-153392 | | 6/1997 |
| JP | 11-126678 | A | 5/1999 |
| JP | 3635062 | B2 | 1/2005 |

* cited by examiner

FIXING DEVICE THAT IS DETACHABLE FROM AN IMAGE FORMING APPARATUS

CROSS REFERENCE TO RELATED APPLICATIONS

This is a Continuation of application Ser. No. 10/290,296, filed Nov. 8, 2002, now U.S. Pat. No. 6,813,456, which is a Continuation application of Ser. No. 09/939,572, filed Aug. 28, 2001, now U.S. Pat. No. 6,522,846, which is a Continuation Application of PCT Application No. PCT/JP99/07411, filed Dec. 28, 1999, which was not published under PCT Article 21(2) in English, the entire contents of which are incorporated herein by reference.

BACKGROUND OF THE INVENTION

1. Field of the Invention

The present invention relates to fixing device provided, for example, on an image forming apparatus and adapted to fix an image of a developing agent transferred to a sheet.

2. Description of the Related Art

This kind of fixing device includes a type adapted to set a pressure applying roller in pressure contact with a heating roller. A sheet with an image of a developing agent transferred thereto is fed to between the heating roller and the pressure applying roller and, by doing so, the image of the developing agent is heated/fused on a sheet and fixed. The heating roller comprises, for example, a metal roller and a tungsten halogen lamp, etc., provided within the metal roller.

Incidentally, the heating source of the tungsten halogen lamp, etc., once converting electric energy to light and heat, heats the metal roller with radiation heat and the heat efficiency is as low as about 60 to 70%. Therefore, it takes more time to start up the fixing operation and a longer wait time is required.

In order to shorten the start-up time, a fixing technique has been developed which uses an induction heating. For example, JPN PAT APPLN KOKAI PUBLICATION NO. 59-33476 discloses the techniques using a roller having a thin metal layer on the outer periphery of a cylinder-like ceramic and performing heating by passing an induction current through the thin metal layer of the roller with the use of a conductive coil. The terminals of the leader lines of the conductive coil are fixed by a fastening means, such as a fastening screw, to the output terminal of a circuit board for outputting a high frequency wave.

Incidentally, the induction heating technique is not restricted to the fixing device and also is adapted in a rice cooker, etc. Since, in the case of the rice cooker, there is almost no need for the maintenance of the induction heating device and its exchange, no problem arises even if the leader line terminals of the coil are fixed by the fastening means, such as the fastening screw, to the output terminals of the circuit board.

In the case of the fixing device, on the other hand, the maintenance and exchange are often necessary. In the case where the leader line terminals of the coil are fixed by the fastening means, such as the fastening screw, to the output terminals of the circuit board, it is necessary to, during the maintenance, exchange, etc., loosen or tighten the fastening means each time and it takes more time to do so.

Further, the tightening strength of the fastening means differs depending upon the operators and it is not possible to achieve a uniform tightening strength. And there is sometimes a possibility that the fastening means will come off if it is too loose and that the circuit board will be destroyed if the fastening means is too tight.

Further, a larger current is supplied and a contact resistance varies depending upon the tightening strength, there being a risk that there occurs a variation in the heating characteristic.

It is to be noted that the above-mentioned problem can be eliminated if the circuit board's output terminals and leader lines are detachably connected through a connector.

However, the conductive coil and leader line, being normally formed by twisting a plurality of (for example, 19) wires, are strong in rigidity. In the case where, therefore, the leader lines are connected in an excessively bent state, the reaction force of the leader line acts on a connection site between the output terminal and the connector, thus causing the connection site to be gradually loosened to bring it to a dangerous state. For this reason, it was usually not possible to connect the leader line's terminal of the conductive coil to the corresponding output terminal of the circuit board directly by a connector.

The present invention is achieved with the above situation in view and the object of the present invention is to provide a fixing device in which one end portion of a conductive connection member is fixed by a fastening means to the output terminal of the circuit board and the leader lines of the coil are detachably connected through a connector to the other end portion of the connection member to allow the attachment and detachment to be made between the output terminal and the leader line of the coil in one operation and, even if the connector is used, it is possible to maintain a better connection state between the output terminal and the leader line of the coil.

BRIEF SUMMARY OF THE INVENTION

The present invention provides an electro-photographic fixing device allowing a flow of an AC current through an electromagnetic induction coil arranged close to an endless member having a metal layer formed of a conductor and allowing the heat generation of the endless member to heat a to-be-fixed member, comprising a circuit board for outputting the current from an output terminal and passing the current through the electromagnetic induction coil, a conductive connection member having one end side fixed by a fastening means to the output terminal of the circuit board, a first connection terminal provided on the other end of the connection member, and a second connection terminal provided at a leader line end of the electromagnetic induction coil and detachably connected to the first connection terminal.

The present invention provides an electro-photographic fixing device allowing a flow of an AC current through an electromagnetic induction coil arranged close to an endless member having a metal layer formed of a conductor and allowing the heat generation of the endless member to heat a to-be-fixed member, comprising a circuit board for outputting the AC current from an output terminal and passing the current through the electromagnetic induction coil, a conductive connection member having one end side fixed by a fastening means to the output terminal of the circuit board, a first connection terminal provided at the other end of the connection member, and a second connection terminal provided at a leader line end of the electromagnetic induction coil and detachably connected to the first connection terminal, wherein the connection member has its thickness made two times or more the current penetration depth.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The embodiment of the present invention will be described below with reference to the accompanying drawings.

Figure 1:
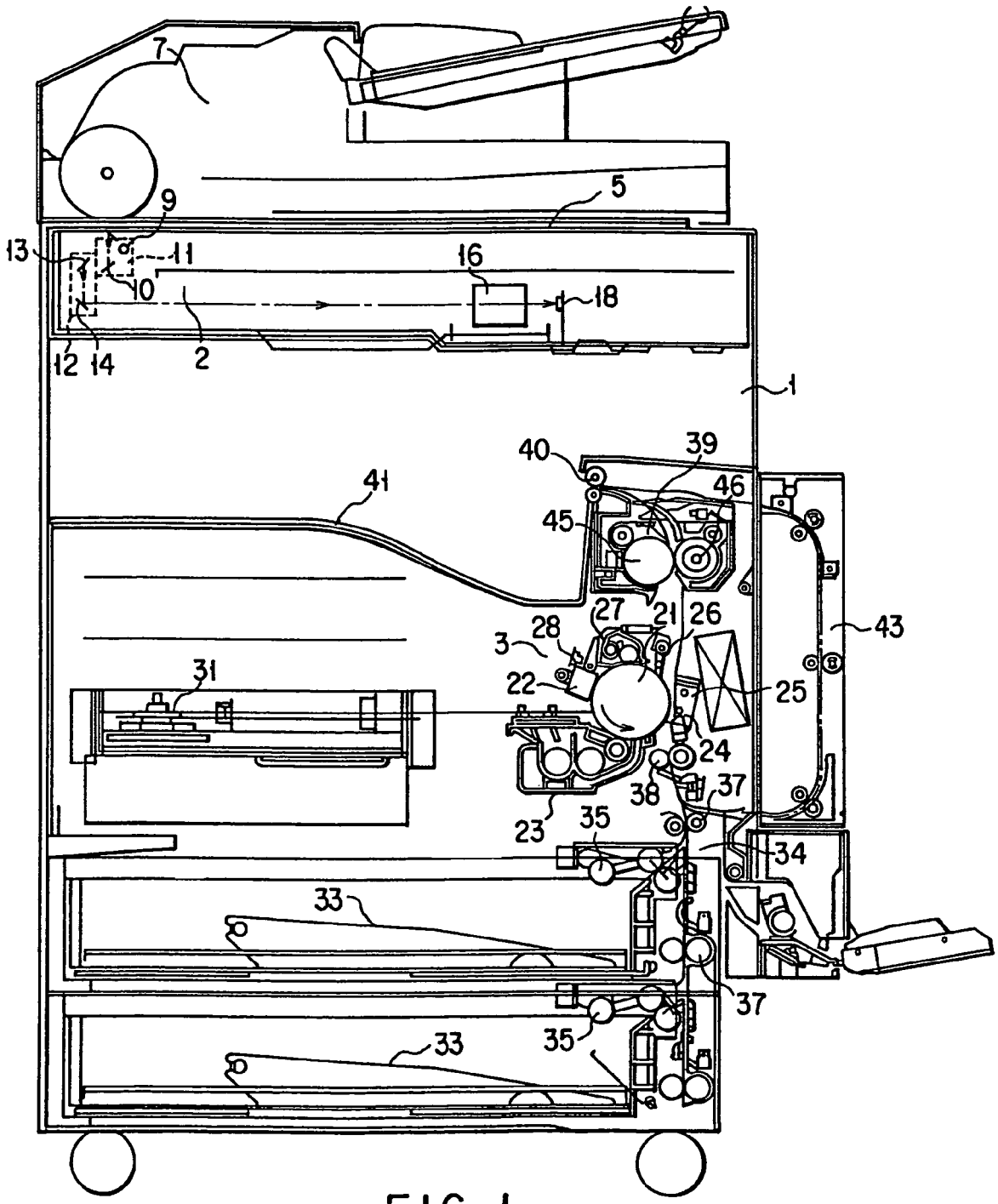
FIG. 1 is a schematic view generally showing an electronic copying apparatus according to-one embodiment of the present invention.

FIG. 1 shows a digital copying apparatus having an apparatus body 1. Within the apparatus body 1 a scanner 2 and image forming section 3 are provided, the scanner 2 serving as a scanning means and the image forming section serving as an image forming means as will be later described.

A document glass 5 made of transparent glass is provided on the upper surface of the apparatus body 1 to allow a document 5 to be placed thereon. Further, an auto-document feeder 7 (hereinafter referred to as an ADF) is arranged above the upper surface of the apparatus body 1 to enable the document to be automatically fed onto the document glass 5.

The scanner 2 arranged within the apparatus body 1 has a light source 9, such as a fluorescent lamp, for illuminating the document placed on the document glass 5 and a first mirror 10 for deflecting light which is reflected from the document toward a predetermined direction. The light source 9 and first mirror 10 are mounted on a first carriage 11 arranged below the document glass 5. Further, a second carriage 12 is arranged below the document glass 5 and is movable parallel to the document glass 5. On the second carriage 12, second and third mirrors 13 and 14 are mounted at a right angle with respect to each other to allow the reflected light from the document which is deflected on the first mirror 10 to be sequentially deflected. The second carriage 12 is driven relative to the first carriage 11 and moved at a speed of ½ relative to the first carriage 11 along the document glass 5.

Further, below the document glass 5 an image formation lens 16 and light receiving sensor 18 are arranged, the image formation lens allowing the reflected light from the third mirror 14 on the second carriage 12 to be focused and the light receiving sensor 18 receiving the light focused by the image formation lens 16.

On one hand, an image forming section 3 has a rotatable photosensitive drum 21 on one side of a substantially middle zone of the apparatus body 1.

Around the photosensitive drum 21, an electric charger 22, developing unit 23, transfer charger 24, separation charger 25, separation claw 26, cleaning unit 27 and discharger 28 are sequentially arranged along the rotation direction of the photosensitive drum.

On the other side of the middle zone of the apparatus body 1, a polygon mirror 31 is rotatably mounted to scan the photosensitive drum 21 with information light corresponding to image information received by the light receiving sensor 18.

In the lower side zone of the apparatus body, cassettes 33 are so provided as to be insertable and withdrawable. Copy sheets are stored in the cassettes 33. On an upper area of one side of he cassette 33, a corresponding pick-up roller 35 is provided to separate/pick up the copy sheets one by one. Within the apparatus body 1, a conveying path 34 is provided in a way to upwardly extend from the cassette 33 past a transfer section situated between the photosensitive drum 21 and the transfer charger 24. In the conveying path 34, a conveying roller pair 37 and register roller pair 38 are provided, the conveying roller pair 37 conveying the copy sheet from the cassette 33 in a sandwiched way and the register roller pair 38 arraying the copy sheet thus conveyed.

On a downstream side of the transfer section of the conveying path 58 a fixing device 39 for fixing an image transferred onto the copy sheet and a discharge roller pair 40 are arranged. A discharge tray 41 receives the sheet discharged toward the discharge direction of a discharge roller pair 40.

It is to be noted that, on the one side zone of the apparatus body, an automatic double-sided device is provided which inverts the copy sheet passed through the fixing device 39 and again feeds it to the image transfer section.

The image forming operation will now be explained below.

A document placed on the document glass 5 is subjected by the scanner 2 to light exposure. The light reflected from the document is passed through the first to third mirrors 10, 13, 14 and image formation lens 16 and received by the light receiving sensor 18 and read out as image information. This image information is photoelectrically converted as information light and sent to the polygon mirror 31. Through the rotation of the polygon mirror 31, the corresponding light is scanned onto the photosensitive drum 21.

The surface of the photosensitive drum 21 is uniformly charged by the electric charger 22 and, through the scanning with the information light, an electrostatic latent image is formed in a form corresponding to the document image. The electrostatic latent image is set to the developing unit 23 through the rotation of the photosensitive drum 21 and a toner is fed from the developing unit 23 to provide a toner image.

On the other hand, at this time, the sheet is picked up by the pick-up roller 35 from the cassette 33 and sent onto the conveying path 34.

The sheet is sent through the conveying roller pair 37 to the register roller pair 38 and, after the leading edge of the sheet is arrayed, sent onto the image transfer section. In the image transfer section, the toner image on the photosensitive drum 21 is transferred to the sheet P under the action of the transfer charger 24. The sheet with the toner image transferred thereto is separated from the outer peripheral surface of the photosensitive drum 44 under the action of the separation charger 25 and separation claw 26 and conveyed to the fixing device 39 where, under the application of heat and pressure, the toner image is fused and fixed. The sheet with the toner image thus fixed is discharged onto the discharge tray 41 through the discharge roller pair 40.

Figure 2:
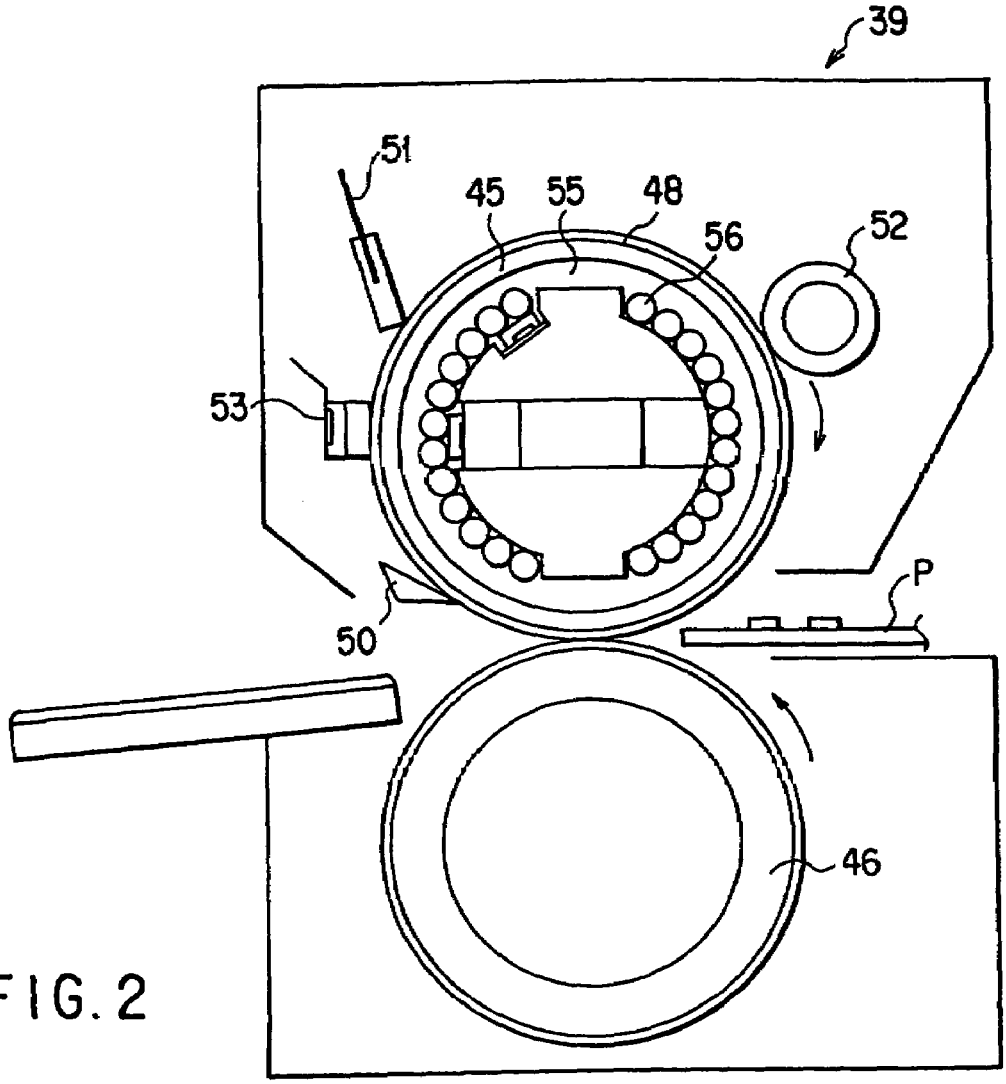
FIG. 2 is a front view in cross-section showing a fixing device.
Figure 3:
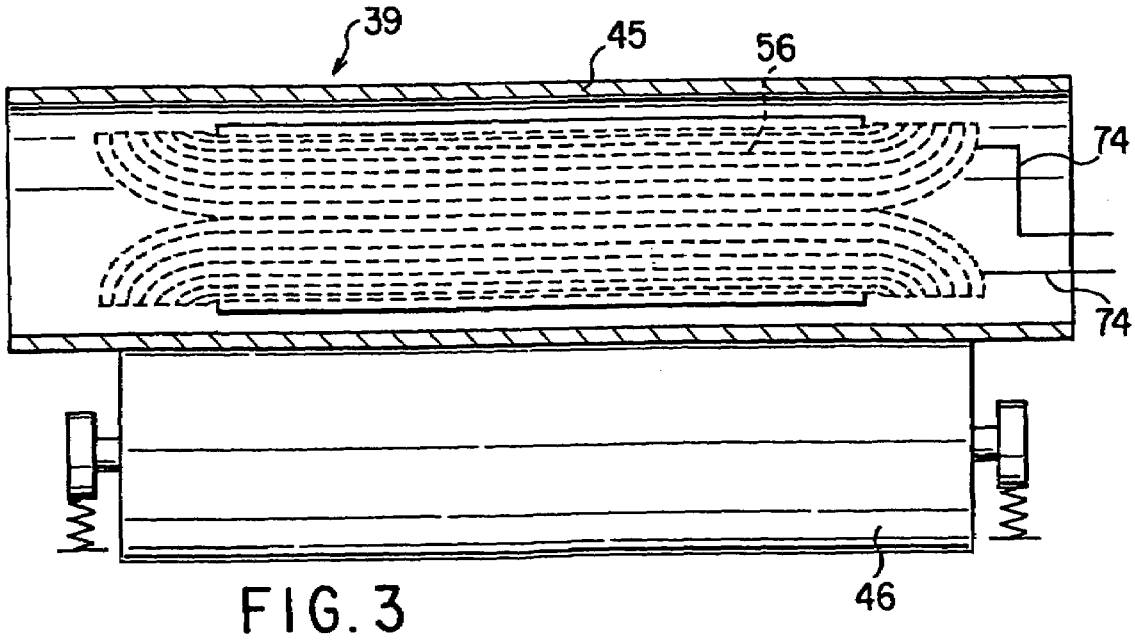
FIG. 3 is a side view in cross-section showing the fixing device.
Figure 4:
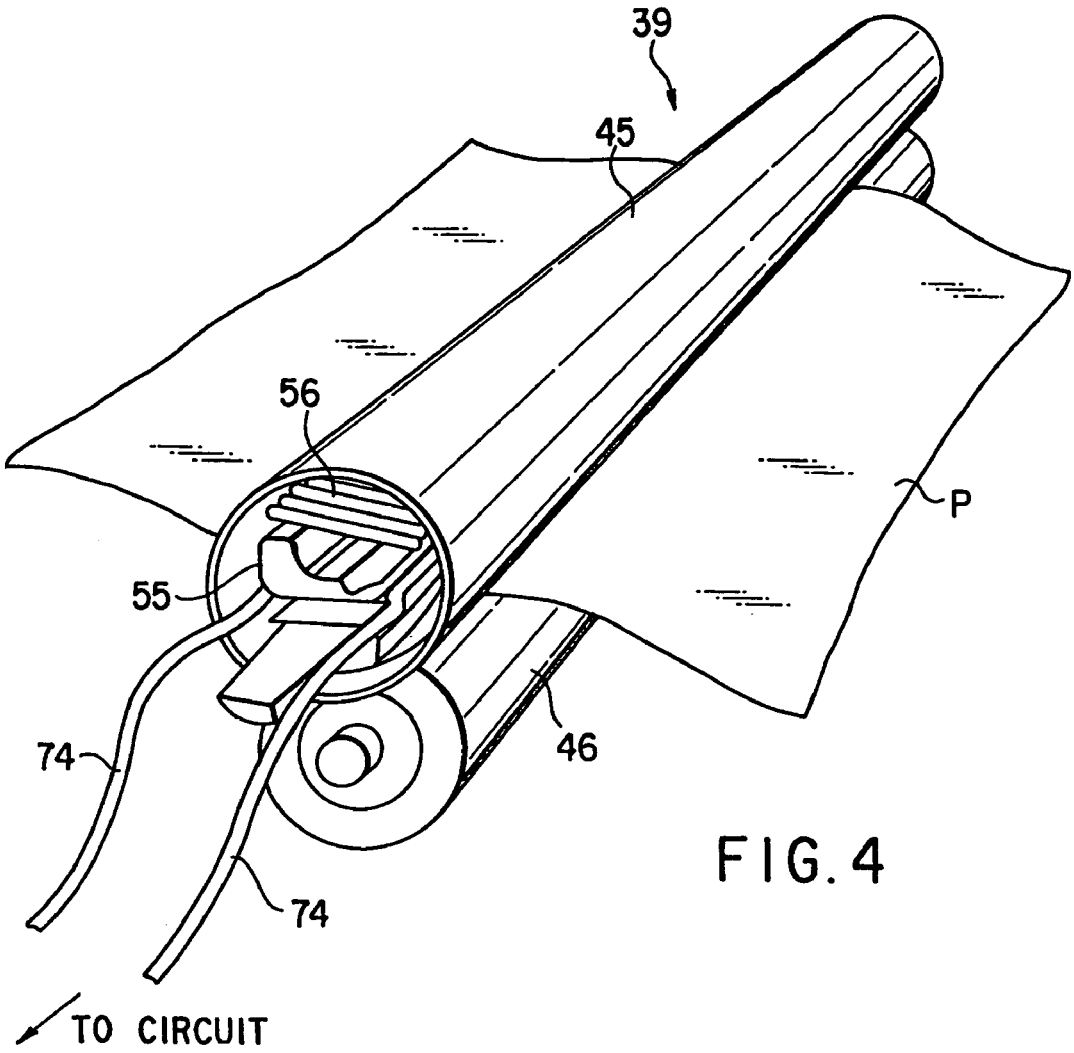
FIG. 4 is a perspective view showing the fixing device.

FIG. 2 is a front view in vertical cross-section showing the fixing device 39 and FIG. 3 is a side view in its vertical cross-section and FIG. 4 is a perspective view thereof.

The fixing device 39 has a heating roller (diameter of 40 mm) 45 serving as a first roller and a pressure applying roller (diameter of 40 mm) 46 placed in pressure contact with the lower side of the heating roller 45 and serving as a second roller. An induction heating device 48 is accommodated within the heating roller 45. The heating roller 45 is connected to a drive mechanism not shown and rotationally driven in a direction indicated by an arrow.

The pressure applying roller 46 is urged, by a pressure applying mechanism not shown, and set in rolling contact with the heating roller 45 with a given nip (contact) width provided. The pressure applying roller 46 is driven by the heating roller 45 and rotated in an arrow-indicated direction.

The heating roller 45 is made of iron and has a thickness of 1.0 mm. A mold release layer of, for example, a fluorine resin is coated on the surface of the heating roller 45. The pressure applying roller 46 is so constructed that, for example, silicon rubber or fluorine rubber is coated around the outer surface of its core metal.

By passing the sheet P as a to-be-fixed material through the nip, that is, a fixing point, between the heating roller 45 and the pressure applying roller 46 a transferred image on the sheet P is heated/fused to provide a fixed image.

A separating claw 50, cleaning member 51, mold release agent coating device 52 and thermistor 53 are arranged on the outer periphery of the heating roller 45 on a downstream side of the rolling contact side between the heating roller 45 and the pressure applying roller 46 as viewed in a rotation direction.

The separation claw 50 separates the sheet P off the heating roller 45 and the cleaning member 51 removes a toner offset on the heating roller 45 and dust, such as a paper dust. Further, the mold release agent coating device 52 coats the mold release agent for offset prevention and the thermistor 53 detects the temperature of the heating roller 45.

The heating principle is based on the use of an induction heating device (magnetic field generating means). The induction heating device is comprised of a magnetic excitation coil 56 and arranged on the inner wall side of the heating roller 45. As the magnetic excitation coil, use is made of a copper wire of 0.5 mm and a plurality of mutually insulated such wires are bundled into a Litz wire. By adopting such Litz wire, the wire diameter can be made smaller than the penetration depth and it is possible to flow an AC current.

In the present embodiment, 19 wires of 0.5 mm in diameter are bundled and as the coil's coating wire, use is made of heat-resistant polyamideimide. As the magnetic field generation means use is not made of any core material (for example, a ferrite core and iron core) for concentrating the magnetic flux of the coil and use is made of a coreless coil. The coil is supported by a coil support member 48 formed of a heat-resistant resin material (heat-resistant EMPEROR in the present embodiment). The coil support member 48 is positioned relative to a plate metal holding a roller, not shown. Since the coreless coil is used in place of any core material of a complicated shape, it is possible to achieve a low cost and also a low-cost magnetic excitation circuit.

Figure 5:
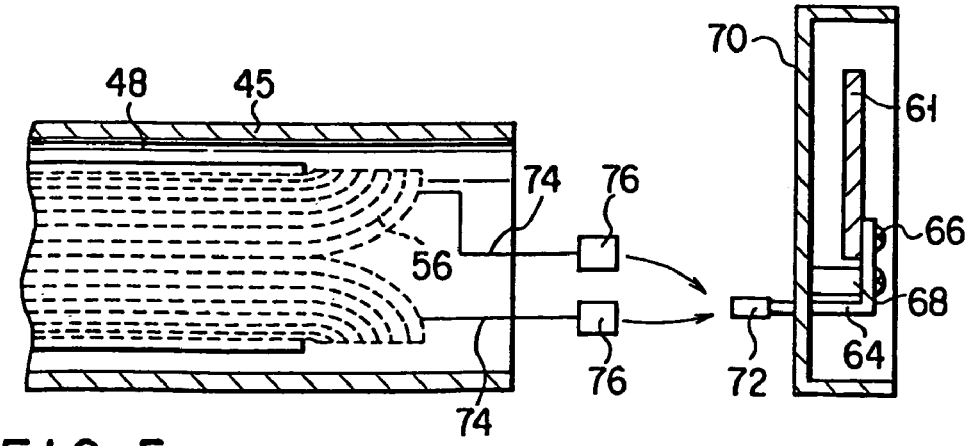
FIG. 5 is a side view showing a connection configuration between coil leader lines of an induction heating device and the output terminals of a circuit board.
Figure 6:
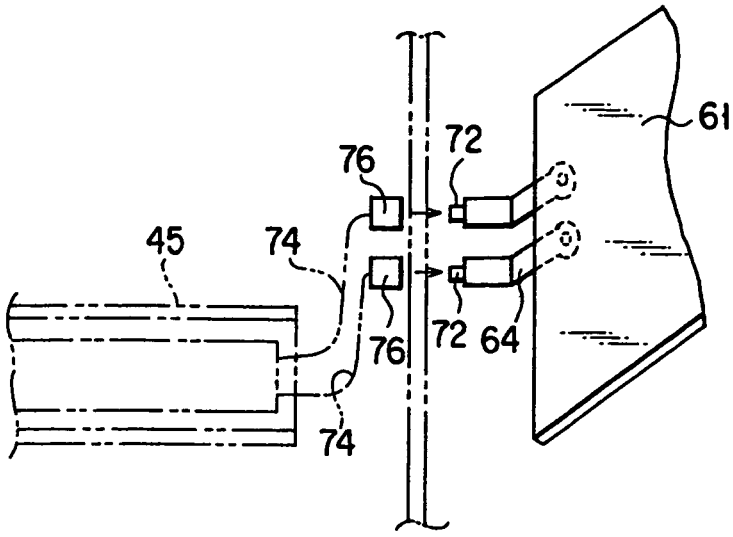
FIG. 6 is a perspective view showing a connection configuration between the coil leader lines of the induction heating device and the output terminal of the circuit board.

FIGS. 5 and 6 show a circuit board 61 for supplying a high frequency current to a coil 56.

Figure 8:
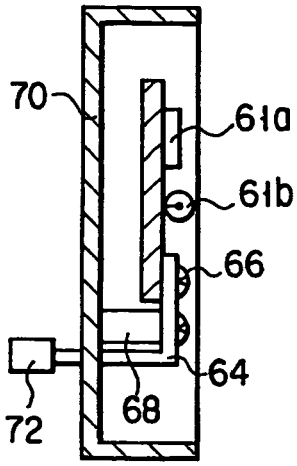
FIG. 8 is a side view in cross-section showing the circuit board of the induction heating device.
Figure 7:
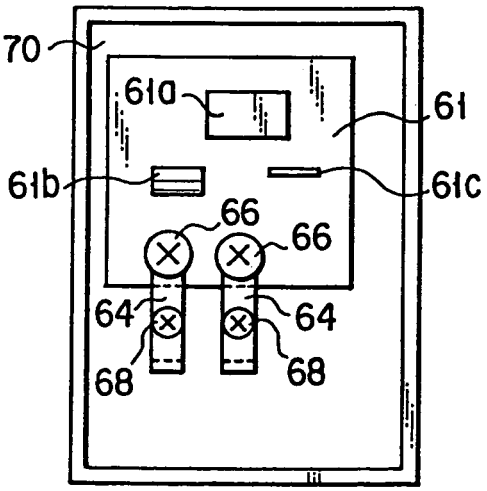
FIG. 7 is a front view showing a circuit board of the induction heating device.
Figure 9:
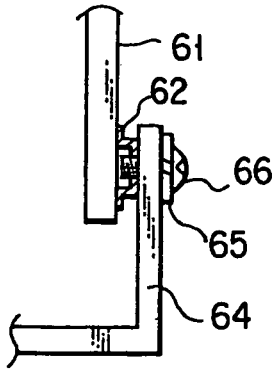
FIG. 9 is an enlarged view showing a connection configuration between the output terminal of the circuit board and a plate metal.

The circuit board 61 has, as shown in FIGS. 7 and 8, various kinds of electronic components 61*a* to 61*c* and output terminals 62, 62 (shown in FIG. 9).

One end portion of an L-bent conductive plate metal 64 serving as a connection member is fixed, by a fastening screw 66 as a fastening means, to the output terminals 62, 62 of the circuit board 61. A spring washer 65 is present between the fastening screw 66 and the plate metal 64. The intermediate portion of the plate metal 64 is mounted by a fastening means 68 on a support frame 70. The support frame 70 is provided opposite to one end face side of the heating roller 45 in a spaced-apart relation. The other end side of the plate metal 64 on the support frame 40 projects from the support frame 70 toward the direction of the heating roller 45 and a male-side connection terminal 72 is mounted as a first connection terminal on that projecting portion.

The thickness of the plate metal 64 is two times or more the current penetration depth. The current flowing in the plate metal 64 is concentrated more toward the surface due to the skin effect to provide a high current density. The depth of the current penetration is used to represent the extent of the current concentration toward the surface. It may be practically possible to consider the depth of the current penetration as the depth of current flowing due to the skin effect.

Thus, if the thickness of the plate metal 64 becomes lower than two-times the depth of the current penetration, the current density becomes too high and the plate metal 64 is overheated, resulting in a dangerous state. According to the present invention, the thickness of the plate metal 64 is made above two-times the depth of the current penetration and, by doing so, it is possible to prevent the current density from becoming too high and maintain a stable state.

A female-side connection terminal 76 is mounted as a second connection terminal to the end of a corresponding leader line 74 of the coil 56. The female-side connection terminal 76 is detachably connected to the male-side connection terminal of the plate metal 64.

Then, an explanation will be made about the maintenance of the heating roller 45 or the detaching and attaching of it during replacement.

In this case, first, the female-side connection terminal 76 of the leader line 74 of the coil 56 brought out from the heating roller 45 is withdrawn out of the male-side connection terminal 72 of the plate metal 67. By doing so, a disconnection is made between the leader lines 74, 74 of the coil 56 and the corresponding output terminals 62, 62 of the circuit board 61. After this disconnection, the heating roller 45 is removed from the apparatus body 1 for maintenance or exchange. After the maintenance has been performed on the heating roller, the heating roller 45 is again inserted into the apparatus body 1. In the case of the exchange, a new heating roller 45 is inserted into the apparatus body 1. After the insertion of the heating roller 45, the female-side connection terminal 76 of the leader line 74 is inserted over the male-side connection terminal 72 of the plate metal 64, so that the connection of them has been made and the mounting of the heating roller has been completed.

In this embodiment, as set out above, the female-side connection terminal 76 of the leader line 74 of the coil 56 is detachably inserted over the male-side connection terminal 72 of the plate metal 64 fixed to the output terminal 62, so that the connection of them is completed. Thus, without loosening or tightening the fastening means as in the conventional case, it is possible to attach or detach the leader line 74 to and from the output terminal 62 in one operation. This ensures a readier maintenance of the heating roller and a readier exchange operation.

Since the plate metal 64, once being fixed to the output terminal 62 of the circuit board 61, need not be removed, it is not necessary, unlike the conventional case, to attach or detach the fastening means for each maintenance or exchange of the heating roller 45. Therefore, there is no variation in a fixing strength between the output terminal 62 and the plate metal 64 and it is, therefore, possible to make the fixing strength uniform to a last moment and improve the reliability.

Since, further, the output terminal 62 of the circuit board 61 and plate metal 64 are connected together by the fastening screw 66, the connection site is not loosened even if a reaction force of the leader line 74 acts upon the connection site, so that a safety can be maintained.

The connection member connected to the output terminal 62 is not restricted to the plate metal and, as such, use may be made of a conductive harness or electric wire.

According to the present invention, as explained above, the leader line of the coil can be attached and detached to and from the output terminal of the circuit board in one operation and it is very easy to achieve the maintenance of the heating roller and exchange the heating roller with a new heating roller.

Further, the output terminal of the circuit board and connection member, once being fixed by the fixing means, are not detached from each other and it is possible to achieve a uniform fastening strength and improve the reliability.

Further, the output terminal of the circuit board is connected by the fastening means to one end of the connection member and the connection site, even if a reaction force of the leader line of the coil acts on the connection site, is not loosened and the reliability is insured.

Further, the thickness of the plate metal is made two times, or more, the current penetration depth and it is, therefore, possible to prevent the current density from becoming too high and maintain a stable state.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a fixing unit including a member having a metal conductive layer and an electromagnetic induction coil arranged adjacent to the member, wherein a flow of an AC current passing through the electromagnetic induction coil allows heat generation by the member to heat a to-be-fixed member;

a circuit board including an output terminal configured to output the AC current to the electromagnetic induction coil of the fixing unit;

a conductive connection member coupled to the output terminal of the circuit board;

a first connection terminal coupled to the connection member; and a second connection terminal at an end of the electromagnetic induction coil of the fixing unit, the first connection terminal and the second connection terminal being configured to connect to each other by inserting one into the other at a time of replacement or maintenance of the fixing unit, wherein the fixing unit is detachable from the image forming apparatus when the first and second connection terminals are not inserted into one another.

2. An image forming apparatus according to claim 1, wherein the connection member is comprised of a plate-like metal material.

3. An image forming apparatus according to claim 1, wherein the connection member is comprised of a harness.

4. An image forming apparatus according to claim 1, wherein the connection member is comprised of an electric wire.

5. An image forming apparatus according to claim 1, wherein the connection member has its thickness made two times or more the current penetration depth.

6. An image forming apparatus according to claim 1, wherein the conductive connection member is coupled to the output terminal of the circuit board by a screw member fixed through a spring.

7. An image forming apparatus according to claim 1, wherein the electromagnetic induction coil comprises a Litz wire comprised of a plurality of leader lines bound together.

8. An image forming apparatus according to claim 1, further comprising:

a third connection terminal coupled to the connection member; and a fourth connection terminal at an end of the electromagnetic induction coil of the fixing unit, the third connection terminal and the fourth connection terminal being configured to detachably connect to each other by inserting one into the other.

9. An image forming apparatus according to claim 8, wherein the fixing unit is detachable from the image forming apparatus when the first and second connection terminals are not inserted into one another and when the third and fourth connection terminals are not inserted into one another.

10. An image forming apparatus according to claim 1, wherein the first connection terminal is one of a male connection and a female connection, and the second connection terminal is the other of a male connection and a female connection.

11. A method for manufacturing an image forming apparatus, comprising:

arranging an electromagnetic induction coil adjacent to a member having a metal conductive layer in a fixing unit to allow heat generation of the member to heat a to-be-fixed member, said electromagnetic induction coil having a first connection terminal;

providing a circuit board for outputting AC current from an output terminal;

coupling a conductive connection member having a second connection terminal to the output terminal of the circuit board; and inserting one of the first connection terminal and a second connection terminal into the other at a time of replacement or maintenance of the fixing unit to enable the AC current output from the circuit board to pass through the electromagnetic induction coil, wherein the fixing unit is detachable from the image forming apparatus when the first and second connection terminals are not inserted into one another.

12. A method according to claim 11, wherein the connection member is comprised of a plate-like metal material.

13. A method according to claim 11, wherein the connection member is comprised of a harness.

14. A method according to claim 11, wherein the connection member is comprised of an electric wire.

15. A method according to claim 11, wherein the connection member has its thickness made two times or more the current penetration depth.

16. A method according to claim 11, wherein the connection member is coupled to the output terminal of the circuit board by a screw member fixed through a spring.

17. A method according to claim 11, wherein the electromagnetic induction coil comprises a Litz wire comprised of a plurality of leader lines bound together.

18. A method according to claim 11, further comprising:

inserting one of a third connection terminal, which is coupled to the conductive connection member, and a fourth connection terminal, which is provided at an end of the electromagnetic induction coil of the fixing unit, into the other to enable the AC current output from the circuit board to pass through the electromagnetic induction coil.

19. A method according to claim 18, wherein the fixing unit is detachable from the image forming apparatus when the first and second connection terminals are not inserted into one another and when the third and fourth connection terminals are not inserted into one another.

20. A method according to claim 11, wherein the first connection terminal is one of a male connection and a female connection, and the second connection terminal is the other of a male connection and a female connection.

21. A detachable fixing unit for use in an image forming apparatus, comprising:

a member having a metal conductive layer;

an electromagnetic induction coil arranged adjacent the member, wherein a flow of an AC current passing through the electromagnetic induction coil allows heat generation by the member to heat a to-be-fixed member; and a first connection terminal provided at an end of the electromagnetic induction coil and configured to be detachably connected to a second connection terminal in the image forming apparatus for providing AC current from the image forming apparatus to the first connection terminal, wherein the first connection terminal and the second connection terminal are configured to connect to each other by inserting one into the other at a time of replacement or maintenance of the fixing unit, wherein the fixing unit is detachable from the image forming apparatus when the first and second connection terminals are not inserted into one another.

22. A fixing unit according to claim 21, wherein the electromagnetic induction coil comprises a Litz wire comprised of a plurality of leader lines bound together.

23. A fixing unit according to claim 21, further comprising:

a third connection terminal provided at an end of the electromagnetic induction coil and being configured to connect to a fourth connection terminal, which is coupled to the connection member in the image forming apparatus, by inserting one of the third connection terminal and the fourth connection terminal into the other.

24. A fixing unit according to claim 23, wherein the fixing unit is detachable from the image forming apparatus when the first and second connection terminals are not inserted into one another and when the third and fourth connection terminals are not inserted into one another.

25. A fixing unit according to claim 21, wherein the first connection terminal is one of a male connection and a female connection, and the second connection terminal is the other of a male connection and a female connection.

26. A method of assembling a fixing unit in an image forming apparatus, comprising:

arranging an electromagnetic induction coil adjacent to a member having a metal conductive layer to allow heat generation of the member to heat a to-be-fixed member, said electromagnetic induction coil having a first connection terminal;

inserting one of the first connection terminal and a second connection terminal, which is in the image forming apparatus, into the other to provide AC current from the image forming apparatus to the first connection terminal, wherein the first connection terminal and the second connection terminal are configured to connect to each other by inserting one into the other at a time of replacement or maintenance of the fixing unit, wherein the fixing unit is detachable from the image forming apparatus when the first and second connection terminals are not inserted into one another.

27. A method according to claim 26, wherein the electromagnetic induction coil comprises a Litz wire comprised of a plurality of leader lines bound together.

28. A method according to claim 26, further comprising:

inserting one of a third connection terminal, which is coupled to the conductive connection member, and a fourth connection terminal, which is provided at an end of the electromagnetic induction coil of the fixing unit, into the other to enable the AC current output from the circuit board to pass through the electromagnetic induction coil.

29. A method according to claim 28, wherein the fixing unit is detachable from the image forming apparatus when the first and second connection terminals are not inserted into one another and when the third and fourth connection terminals are not inserted into one another.

30. A method according to claim 26, wherein the first connection terminal is one of a male connection and a female connection, and the second connection terminal is the other of a male connection and a female connection.

* * * * *